United States Patent [19]

Przewalski

[11] Patent Number: 4,889,484

[45] Date of Patent: Dec. 26, 1989

[54] PORTABLE SOIL DECONTAMINATION KILN

[75] Inventor: Zygmunt J. Przewalski, Granby, Conn.

[73] Assignee: M & S Engineering & Manufacturing Co., Inc., Broad Brook, Conn.

[21] Appl. No.: 137,968

[22] Filed: Dec. 28, 1987

[51] Int. Cl.[4] ..... F27B 7/00

[52] U.S. Cl. ..... 432/103; 432/105; 110/246

[58] Field of Search ..... 432/103, 105; 110/246

[56] References Cited

U.S. PATENT DOCUMENTS

| | | | |
|---|---|---|---|
| 3,631,824 | 1/1972 | Smuck | 110/246 |
| 3,822,651 | 7/1974 | Hanis et al. | 110/246 |
| 3,861,335 | 1/1975 | Przewalski | 432/105 |
| 3,918,893 | 11/1975 | Whitaker | 432/105 |
| 4,066,024 | 1/1978 | O'connor | 110/246 |
| 4,266,931 | 5/1981 | Struckmann | 110/246 |
| 4,724,777 | 2/1988 | Reed et al. | 110/246 |

*Primary Examiner*—Henry C. Yuen

*Attorney, Agent, or Firm*—Hayes & Reinsmith

[57] ABSTRACT

In a thermal reductor unit for decontaminating soil of combustible and volatile fluids, as interior drum is mounted concentrically within a shell in surrounding relation to an ignition chamber. An annular space between the drum and shell provides a compartment wherein soil being processed is received to serve as an insulating medium for the ignition chamber.

16 Claims, 6 Drawing Sheets

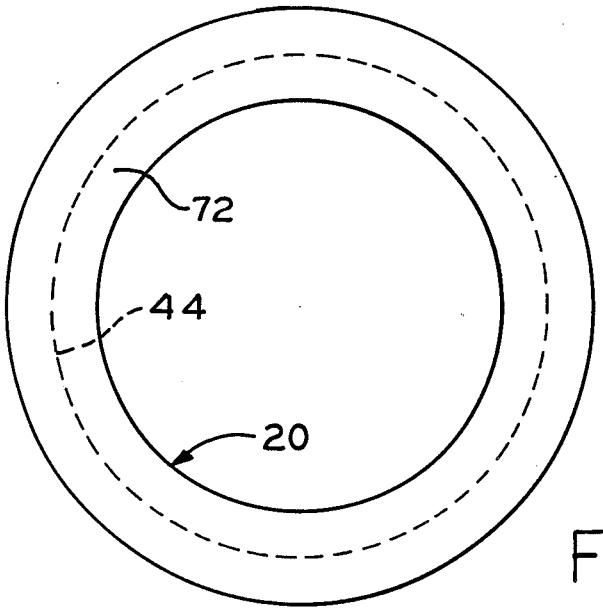
FIG. 5
FIG. 4
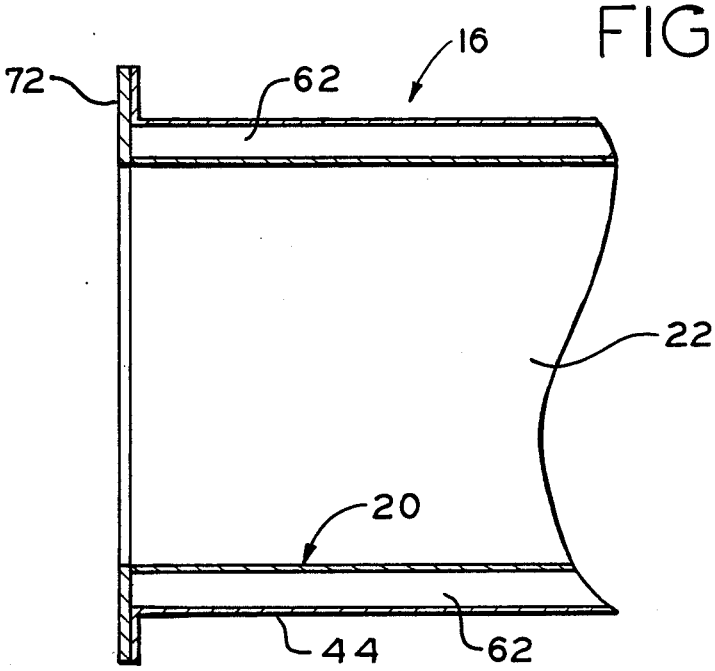

PORTABLE SOIL DECONTAMINATION KILN

FIELD OF THE INVENTION

This invention relates generally to waste disposal and is more particularly directed to a new and improved portable thermal reduction unit which is quickly and easily transported to sites requiring soil decontamination.

BACKGROUND OF THE INVENTION

Thermal reduction systems including rotary kilns are known wherein a cylindrical chamber having a refractory insulated lining is supported for rotation about a longitudinally extending axis and is provided with a burner. Combustible gases leaving the ignition chamber are drawn through a separator to remove dust and are then burned in a combustion chamber to produce an exhaust meeting federal and local environmental emission standards. The walls of the combustion zones have conventionally been lined with heavy, high temperature refractory material suitable for operation within the temperatures to which the incinerator is subjected, such as temperatures up to 2000° F.

Decontamination of soils polluted with combustible and volatile substances such as gasoline and oil normally has been restricted to soil removal. However, transport of these wet solids is costly. Further, regulatory and zoning restrictions limit the locations where contaminated soils may be deposited. Conventional thermal reduction systems have not been practicable means for removing combustible and volatile pollutants from soil because the abrasive nature of most soils causes excessive wear of rotating chambers having refractory linings and because constructing such a system at any given site is simply cost prohibitive.

OBJECTS OF THE INVENTION

A primary object of this invention is to provide a new and improved portable thermal reductor unit that is light weight and compact for quick and easy transport for disposing of soil in situ.

Another object of this invention is to provide such a thermal reductor unit particularly suited to dispose of soil contaminated with combustible materials including fluids having low to moderate heats of vaporization.

A further object is to provide a unit of the above described type having soil consumption capabilities for meeting a wide variety of demanding applications in an efficient effective process with environmentally acceptable stack emissions.

Another object of this invention is to provide a unit of the above type which is less susceptible to abrasive wear caused by combusting waste in process.

Another object is to provide a unique thermal reductor unit of improved efficiency and which is particularly suited for ready transport by the provision of a removable insulating lining which may comprise the soil that is being decontaminated.

Other objects will be in part obvious and in part pointed out in more detail hereinafter.

SUMMARY OF THE INVENTION

The present invention, in simplest terms, provides an ignition chamber defined by an internal drum of a rotary housing. So that the ignition chamber is particularly suited to be used for decontamination of soil with portable equipment, the drum has one-way flow control means intermediate input and output ends of the chamber to permit a unidirectional passage of soil between the drum and housing during its rotation to form an insulating lining of soil in surrounding relation to the ignition chamber.

A better understanding of the objects, advantages, features, properties and relations of the invention will be obtained from the following detailed description and accompanying drawings which set forth illustrative embodiments and are indicative of the ways in which the principles of the invention are employed.

BRIEF DESCRIPTION OF THE DRAWINGS

FIG. 4 is a view, partly broken away and partly in section, of one end of the housing of FIG. 2;

FIG. 5 is an end view of the housing of FIG. 4;

DETAILED DESCRIPTION OF THE INVENTION

Figure 1:
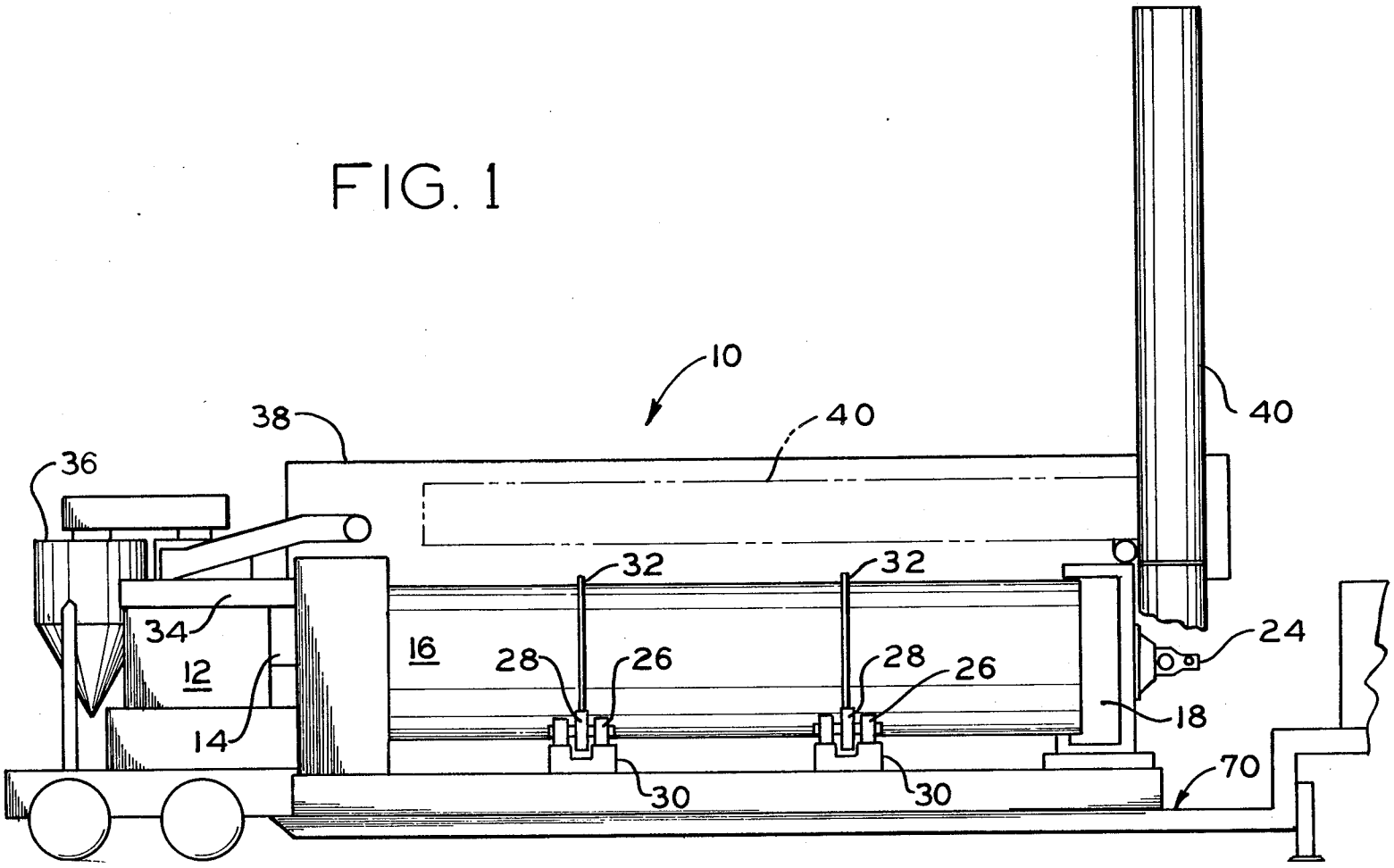
FIG. 1 is a side view, partly broken away, illustrating a portable thermal reductor unit of this invention.
Figure 2:
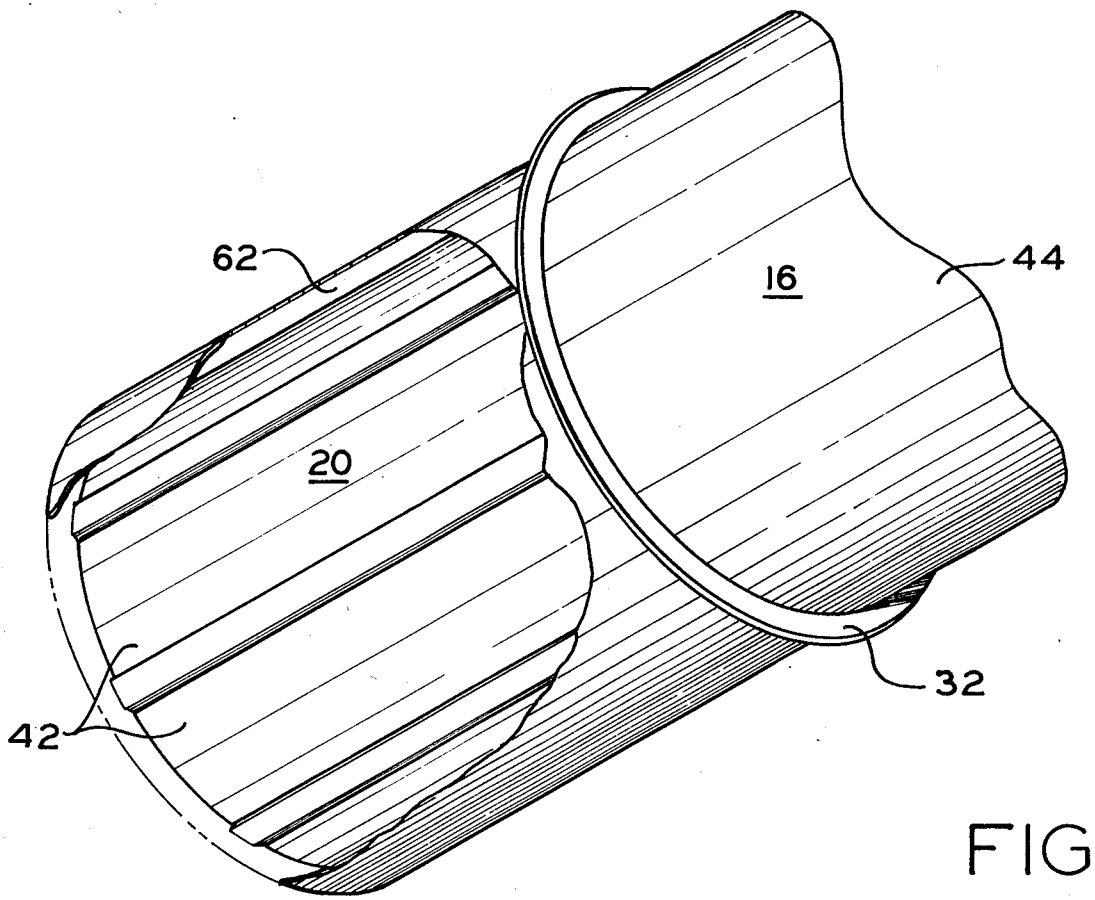
FIG. 2 is an isometric view, partly broken away and partly in section, showing an ignition chamber housing embodying certain features of this invention.

Referring to the drawings in detail, a thermal reduction unit 10 is illustrated in FIG. 1 for continuous processing of solid, sludge and liquid wastes. This unit however, is particularly suited for disposing of soil contaminated with combustible fluids such as at a gasoline service station wherein leakage of petroleum products has contaminated the soil or wherein it is required to replace a tank at such a station. Any suitable waste feeder 12 is provided, e.g., by conventionally available equipment or combination of devices such as a screw conveyor, mechanical pusher, pumping apparatus and/or liquid atomizing devices for supplying waste through an opening, not shown, in an input end 14 of a housing 16 for a rotary thermal reduction unit of the general type described in my U.S. Pat. No. 3,861,335, the subject matter of which is incorporated herein by reference.

Figure 3:
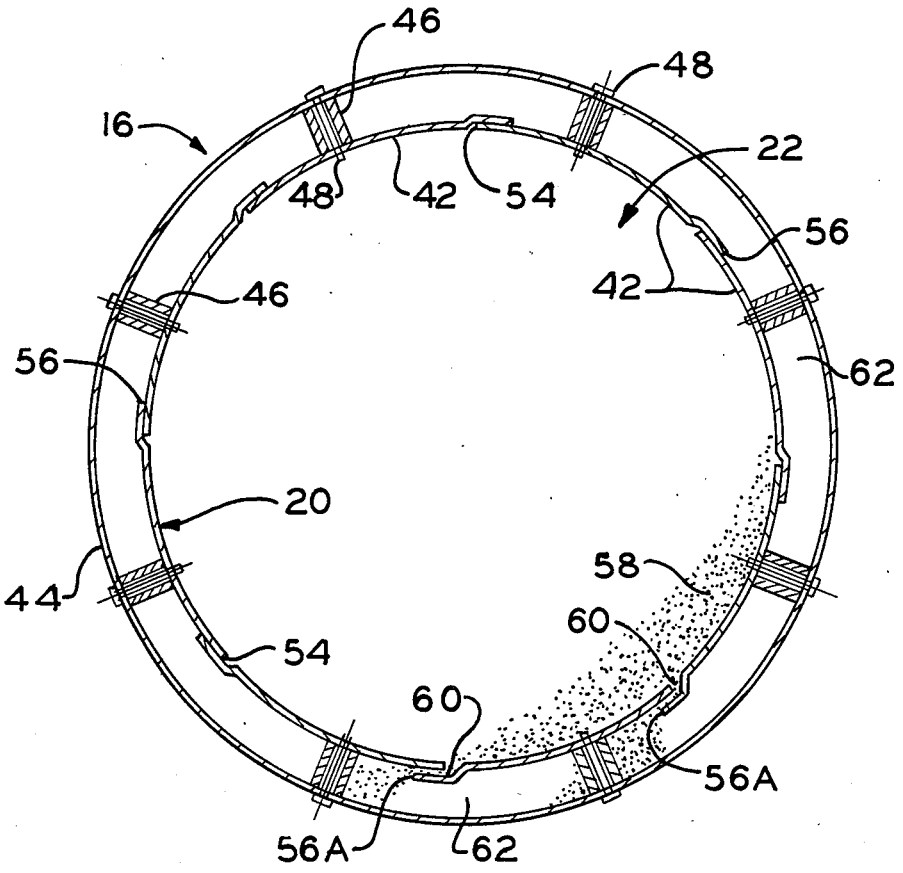
FIG. 3 is a cross-sectional view of the ignition chamber housing of FIG. 2.
Figure 6:
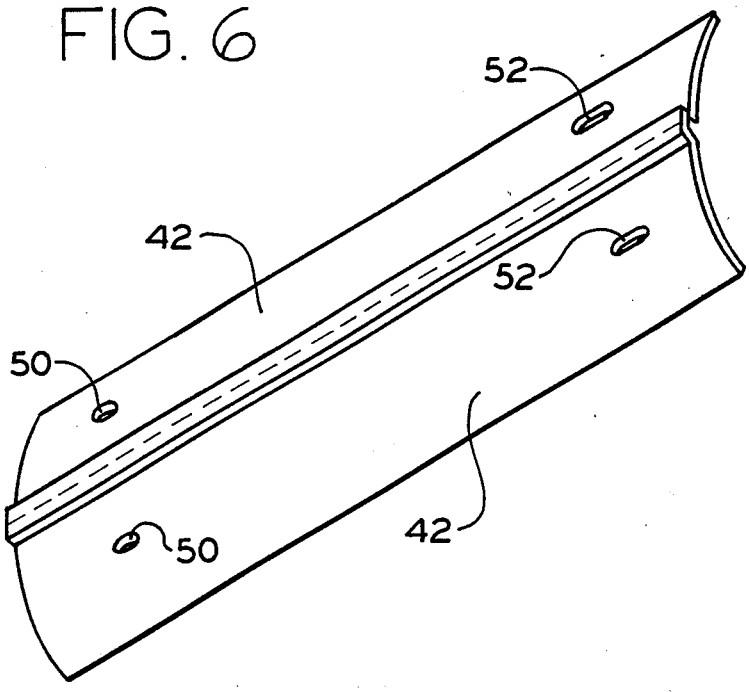
FIG. 6 is an isometric view showing a pair of drum plates in side-by-side relation of a type used in the housing of FIG. 3.
Figure 7:
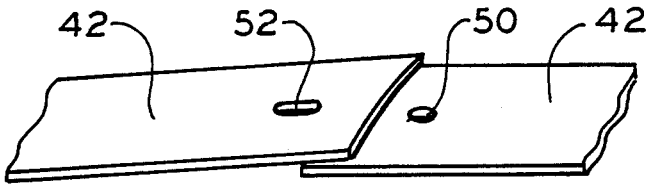
FIG. 7 is an isometric view, partly broken away, showing an expansion joint detail of longitudinally aligned drum plates.

Housing 16 has a discharge end 18 of enlarged size relative to the input end 14 and a drum 20 (FIG. 3) defines an ignition chamber 22 within the housing 16 to promote natural flow of gases, unconsumed particulate or smoke, and decontaminated soil discharge toward the discharge end 18. During processing, soil moves inside the rotating ignition chamber 22 toward its discharge end 18 while the soil is heated by a burner 24 and is decontaminated prior to being discharged at the discharge end 18.

Suitable rotary drive means 26 including rollers 28 are mounted on base supports 30 for engaging axially spaced guide tracks 32 circumferentially extending about housing 16 to support the housing 16 for horizontal rotation about a longitudinally extending horizontal axis of the chamber as fully described in my above referenced U.S. Pat. No. 3,861,335.

The ignition chamber 22 is preferably preheated by burner 24 to operating temperature prior to charging contaminated soil to the ignition chamber 22. The operating temperature within the ignition chamber 22 may be maintained within a range of about 600° F. to 1200° F. for many soil decontamination operations. By maintaining the reductor chamber temperature in this range, the unit provides a unique and efficient reduction process to remove combustible fluids from soils contaminated with those fluids. It is to be understood, however, that other materials to be decontaminated in the ignition chamber may require much higher temperatures, say, to about 1800° F., depending upon the materials and rotational speed of the chamber housing 16.

The soil which is first fed into the input end 14 of the ignition chamber 22 is decontaminated therein, abrasively tumbled by rotation of housing 16 and automatically advanced toward the discharge end 18 (by a frustonical internal configuration of chamber 22, if desired). Solid non-combustibles settle to the bottom of rotating housing 16 and are continuously discharged and collected from unit 10 in a suitable container through discharge end 18. The volatized products of combustion and evaporation are directed into a heat recuperator 34 and then into a cyclone separator 36. Dust and other particulate matter are removed from the exhaust gases by the cyclone separator dry scrubber 36. Flue gases exiting the cyclone separator 36 are directed to a secondary oxidation chamber 38 to complete combustion of volatized compounds prior to exhaust from the thermal reductor unit 10 through exhaust stack 40. Accordingly, all combustible materials are decomposed into volatized gases and ash.

Heretofore, such decontamination in situ has not been achieved because of the inherent immobility of conventional equipment. To reduce the weight of such equipment and to permit its ready portability from site to site while providing durability and an abrasion resistant chamber among other advantages, the drum 20 defining the ignition chamber 22 has means therein to trap soil-in-process to serve as an insulating liner for the ignition chamber 22. Following completion of an operation at a given site of decontamination, soil trapped between the drum 20 and rotary housing shell 44 may be removed as described below.

In accordance with this invention, the ignition chamber 22 shown in the first embodiment of FIGS. 2–7, has its drum 20 defined by a plurality of individual elongated resilient plates as at 42 (FIG. 3) longitudinally disposed side-by-side within the rotary housing 16 and forming a generally cylindrical inner unit concentric to the outer housing shell 44 in spaced relation to that shell. The plates 42 are each supported independently by radially disposed tubular spacers 46 secured by fasteners or bolts 48 fixed to the housing shell 44 and extending through the spacers 46 and registering apertures such as at 50, 52 in plates 42. Spacers 46 establish spacing between each plate 42 of the inner drum 20 and its outer housing shell 44.

More specifically, each plate 42 is independently mounted on housing shell 44 by one or more supporting fasteners 48 each extending through a spacer 46. One fastener 48 will be understood to be received within an aperture 50 (FIGS. 6 and 7) at one end of each plate 42. At the opposite end each plate 42 is an elongated slot 52. Another fastener 48 is fixed to the external housing shell 44 to protrude through that elongated slot 52 which extends longitudinally along plate 42 to accommodate thermal expansion and contraction responsive to the plate 42 being subjected to widely varying temperatures.

Accordingly, thermal expansion of each plate 42 independently of its respective support fasteners 48 is permitted by movement of each plate relative to its fasteners. To provide for kilns of larger dimension, say, over 10 feet in length, a series of plates may be mounted longitudinally within the external housing shell 44 by lapping one end of one plate fixed by a fastener through aperture 50 (FIG. 7) with an adjacent end of an adjoining longitudinally aligned plate, thereby providing an expansion joint.

The plates 42 are mounted side-by-side (FIG. 6) in an annular configuration on the support fasteners 48. Each plate 42 is mounted on its fasteners 48 between opposite lateral sides of the plate. In the preferred embodiment, the fasteners 48 (FIG. 3) are preferably located in alignment on each plate and positioned (in cross section) closer to a leading side edge 54 of the plate 42 than to its offset trailing side edge 56, assuming that drum 20 rotates counter-clockwise as viewed in FIG. 3. Consequently, with the trailing side edge of each plate serving as the longer lever arm relative to its spacers 46, the trailing side edge 56 of each plate 42 will deflect (as seen at 56A, FIG. 3) to move radially outwardly about its spacers 46 under the weight of soil 58 within ignition chamber 22 during its rotation.

This action creates openings 60 between the trailing side edge 56A of one plate and a leading side edge 54 of the next adjacent plate at the lower course of the drum rotation. Soil automatically falls into those spaces created by the weight of soil at the deflected trailing side edges 56A, each of which is shown as being in offset stepped relation to the body of its plate, and subsequently into compartment 62 between the inside drum 20 and outside housing shell 44. As the ignition chamber shell 44 continues to rotate, soil within the chamber 22 shifts relative to the plates 42 mounted within the housing 44. This action successively relieves the force deflecting the offset trailing edge 56 of each plate 42 to permit it to return radially inwardly, thereby causing each such edge to re-engage the leading edge 54 of the next adjacent plate and accordingly close the opening 60 to prevent soil from escaping compartment 62.

Soil between the inside wall of drum 20 and housing shell 44 also moves with continuing rotation of the drum 20 toward the opposite longitudinal end of the insulating compartment 62. Such movement of soil between the inside drum 20 and housing shell 44 makes space available to trap more soil during following revolutions of the drum 20 when the trailing edge as at 56A of each plate 42 again deflects and is disengaged from its adjoining plate. Continued rotation of drum 20 eventually will create a complete layer of soil to form between drum 20 and housing shell 44, thereby fully insulating the outer shell 20 from the effects of combustion and evaporation of any fluids contained in soils fed to the ignition chamber 22. Once that insulating layer is fully formed, the trailing edges 56 of the plates 42 cease flexing at the lower course of their angular travel and simply remain engaged with the leading edge of their adjacent plate.

Figure 8:
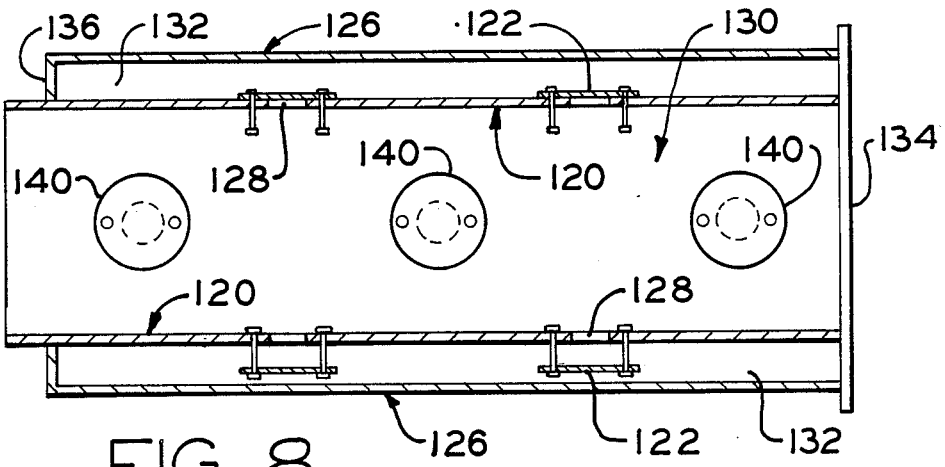
FIG. 8 is a side view, partly in section, of another embodiment of an ignition chamber housing of this invention.
Figure 9:
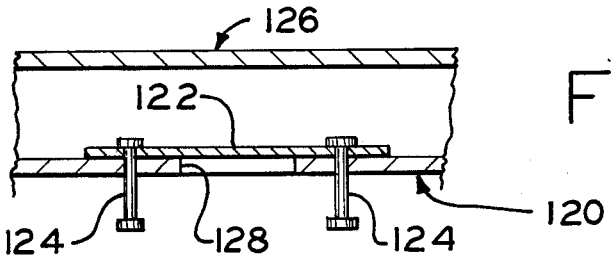
FIG. 9 is an enlarged side view, partly in section and partly broken away, showing a one-way valve of the housing of FIG. 8 in a closed position.
Figure 10:
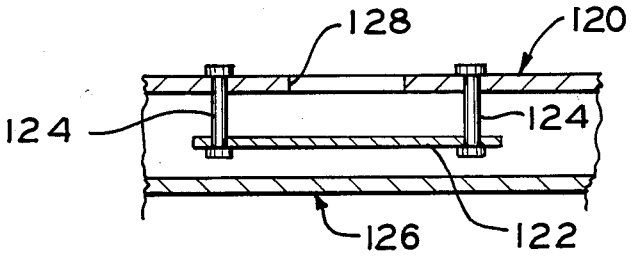
FIG. 10 is an enlarged side view, partly in section and partly broken away, showing a one-way valve of the housing of FIG. 8 in an open position.

In another embodiment of this invention as seen in FIGS. 8–10, internal drum 120 is perforated. Valve plates 122 are shown loosely attached by pins 124 to the wall of the drum 120 which is in confronting concentric relation to the inner wall of the surrounding housing shell 126. These plates 122 automatically drop under the force of gravity to cover openings 128 within the drum 120 as it approaches the apex of its rotation (FIG. 9) and alternately fall under the force of gravity and weight of soil within chamber 130 and are retained by their supporting pins 124 in spaced relation to the drum 120 at the lowest part of its rotation (FIGS. 10) to allow soil to pass through the openings 128. The soil becomes trapped in the space or insulating compartment 132 defined between the shell 126 and the drum 120 to create an insulating layer of soil surrounding the ignition chamber 130.

More specifically, the pins 124 are shown each having enlarged heads at their opposite ends, and the plates 122 are attached to the drum 120 by these pins 124 which in turn are loosely fitted within holes in the drum 120 to alternately allow movement of the plates 122, as previously described, away from and into contact with the drum 120 during its rotation. However, plates 122 may be attached to the drum 120 by other means such as by hinges, for example. The drum 120 is shown supported at its opposite longitudinal ends. In the specifically illustrated embodiment shown in FIG. 8, corresponding ends of drum 120 and shell 126 are attached to an end plate 134, thereby enclosing the insulating compartment 132. The opposite end of drum 120 freely extends through a circular opening defined by a reduced annular end wall 136 of shell 126 within which the drum 120 is supported and may move during its expansion and contraction responsive to temperature changes.

Charging of the ignition chamber 130 may be either on a continuous or batch feed basis which can be adjusted to the speed of rotation and to temperature for optimum continuous soil decontamination processing. Likewise, operation of the burners for the described chambers 22 and 130 may be intermittent on a demand basis once operating temperature is reached within the chambers. The above summary of operation does not specifically describe certain details of various controls, circuitry and piping arrangements, for a variety of different circuits and controls may be employed in accordance with conventional techniques to effect system operation on manual, semi-automatic or automatic process sequencing.

The operation of the unit in accordance with the above described construction will effectively decontaminate soils containing combustible fluids such as gasoline, oil and other petroleum products. The disclosed apparatus may be easily transported on a low flat bed trailer such as shown at 70 in FIG. 1. As will be appreciated, an apparatus of the type disclosed provides for passage of soil into the insulating compartment which is in surrounding relation to the ignition chamber. That soil movement is permitted by the disclosed flow control means which serve as one-way check valves whereby the soil being processed serves as an insulating medium for the ignition chamber.

The operating temperature of the kiln and selection of material for the drum 20, 120 varies with the applications. For kiln operating temperatures below 600° F., e.g., in processing soil contaminated with gasoline, carbon steel can be used as plate or drum material. In processing contaminants requiring temperatures up to 1200° F., stainless steel of high nickel content is used. When temperatures of 1800° F. or above are encountered, a high temperature alloy such as Inconel 600 may be used. By providing an inner ignition chamber wall of such a metal material, significantly improved resistance is achieved to withstand wear and abrasion, as well as mechanical and thermal shocks from cold soil falling onto the hot chamber wall and vibration from kiln movement.

Upon completion of a soil decontamination operation, the soil within the insulating compartment may be removed by any suitable means such as by counter-rotating the housing shell 44 (FIG. 3), removing its end collar 72 (FIGS. 4 and 5) or housing wall 134 (FIG. 8) or by opening hatches such as those shown at 140 (FIG. 8) and thereafter removing the soil by mechanical or manual means or even by vacuum.

The trailer 70 is preferably equipped with air ride suspension and leveling capabilities for easy transportation and set-up at the disposal site. Its stack 40 may be mounted for movement between an upright operative and inoperative transport positions respectively shown in full lines and broken lines in FIG. 1. Depending on the site requirements, some additional portable auxiliary equipment may be required and may be attached to the unit, such as an auxiliary fuel tank to supply the burners and a scrubber water treatment tank, if desired. However, the trailer 70 itself will be understood to have certain main components mounted on it including its feed unit 12, rotating kiln (within housing 16), secondary combustion or oxidation unit 38, and air pollution control devices such as an afterburner, recirculating cyclone dry scrubber 36, exhaust fan and stack 40. Trailer 70 also may be equipped with its own electrical generator and control system, which in cooperation with the described components, can provide conditions for total oxidation of contaminated soil.

As will be apparent to persons skilled in the art, various modifications, adaptations and variations of the foregoing specific disclosure can be made without departing from the teachings of this invention.

I claim:

1. Apparatus for decontaminating soil in a thermal reduction process comprising a rotary housing having an external shell and an internal drum, the drum defining an ignition chamber therein, the shell and drum jointly defining an insulating compartment therebetween in surrounding relation to the ignition chamber, the drum having one-way check valve means operated under the force of gravity between open and closed positions permitting passage of soil being processed from the ingition chamber into the surrounding insulating compartment, that soil in the insulating compartment serving as an insulating medium for the ignition chamber.

2. The apparatus of claim 1 wherein the shell and drum each are cylindrical and concentric about a longitudinal axis extending generally horizontally through the drum, and wherein the drum is mounted within the shell for rotation in unison therewith.

3. The apparatus of claim 1 further including a rotary drive for rotating the housing shell about a generally horizontally extending axis.

4. The apparatus of claim 1 wherein the flow control means comprises one-way check valve means within the drum operated under force of gravity between open and closed positions.

5. The apparatus of claim 1 wherein the drum includes a series of elongated plates extending longitudinally in side-by-side relation to one another and forming a generally cylindrical unit, and support means mounting each of the plates within the shell.

6. The apparatus of claim 5 wherein each plate is secured by its support means at an off-center location relative to a major longitudinal axis of the plate, wherein opposite longitudinally extending side edges of each plate are in lapping relation to the adjacent plates, one side edge of each plate being movable relative to an adjacent plate under the gravity force of soil being processed within the ignition chamber for opening the insulating compartment to said soil passage thereto.

7. The apparatus of claim 5 wherein the support means comprises spacers between the shell and plates with the spacers connecting the same.

8. The apparatus of claim 5 wherein edges of adjacent plates lap one another generally parallel to the axis of rotation of the housing.

9. The apparatus of claim 5 wherein the support means includes a connection for slidably connecting each plate to the shell to permit thermal expansion and contraction of each plate.

10. The apparatus of claim 1 wherein the drum is formed of metal.

11. The apparatus of claim 1 wherein the drum and shell are mounted on a trailer to permit mobility as a unit.

12. Apparatus for decontaminating soil in a thermal reduction process comprising a rotary housing having an external shell and an internal drum, the drum defining an ignition chamber therein, the shell and drum jointly defining an insulating compartment therebetween in surrounding relation to the ignition chamber, the drum having flow control means permitting passage of soil being processed from the ignition chamber into the surrounding insulating compartment, that soil in the insulating compartment serving as an insulating medium for the ignition chamber, the flow control means comprising an opening in the drum and a movable valve plate mounted between the drum and shell for alternately opening and closing the drum opening.

13. The apparatus of claim 12 wherein the valve plate is mounted on the drum for movement between open and closed positions under the force of gravity, the drum and valve plate cooperating to effect communication between the ignition chamber and its surrounding insulating compartment such that the force of gravity on soil in the ignition chamber during rotation directs soil through the drum opening into the insulation compartment with the valve plate in open position.

14. Apparatus for decontaminating soil in a thermal reduction process comprising a rotary housing having an external shell and an internal drum, the drum defining an ignition chamber therein, the shell and drum jointly defining an insulating compartment therebetween in surrounding relation to the ignition chamber, the drum having flow control means permitting passage of soil being processed from the ignition chamber into the surrounding insulating compartment, that soil in the insulating compartment serving as an insulating medium for the ignition chamber, the drum including a series of elongated plates extending longitudinally in side-by-side relation to one another and forming a generally cylindrical unit, and support means mounting each of the plates within the shell, each plate of the drum being secured by its support means at an off-center location relative to a major longitudinal axis of the plate, opposite longitudinally extending side edges of each plate being in lapping relation to the adjacent plates, one side edge of each plate being movable relative to an adjacent plate under the gravity force of soil being processed within the ignition chamber for opening the insulating compartment to said soil passage thereto, and said one side edge of each plate being movable into engagement with its adjacent plate for closing the insulating compartment upon further rotation of the drum into an angularly displaced position relative to that position wherein the plate permits soil passage into the insulating compartment.

15. Apparatus for decontaminating soil in a thermal reduction process comprising a rotary housing having an external shell and an internal drum, the drum defining an ignition chamber therein, the shell and drum jointly defining an insulating compartment therebetween in surrounding relation to the ignition chamber, the drum having flow control means permitting passage of soil being processed from the ignition chamber into the surrounding insulating compartment, that soil in the insulating compartment serving as an insulating medium for the ignition chamber, the drum including a series of elongated plates extending longitudinally in side-by-side relation to one another and forming a generally cylindrical unit, and support means mounting each of the plates within the shell, one side edge of each plate being in trailing relation to an opposite leading edge of the plate, said support means being in closer lateral proximity to the leading edge of the plate than to its trailing edge.

16. Apparatus for decontaminating soil in a thermal reduction process comprising a rotary housing having an external shell and an internal drum, the drum defining an ignition chamber therein, the shell and drum jointly defining an insulating compartment therebetween in surrounding relation to the ignition chamber, the drum having flow control means permitting passage of soil being processed from the ignition chamber into the surrounding insulating compartment, that soil in the insulating compartment serving as an insulating medium for the ignition chamber, the drum including a series of elongated plates extending longitudinally in side-by-side relation to one another and forming a generally cylindrical unit, and support means mounting each of the plates within the shell, the support means including a connection for slidably connecting each plate to the shell to permit thermal expansion and contraction of each plate, the drum having one end fixed to the shell and an opposite end slidably mounted relative to the shell to permit independent relative thermal expansion and contraction of the drum and shell.

* * * * *